United States Patent [19]

Mooney

[11] Patent Number: 4,886,079

[45] Date of Patent: Dec. 12, 1989

[54] COSMETIC TEMPLATE

[76] Inventor: Lillian A. Mooney, 7520 E. 550 South, Zionsville, Ind. 46077

[21] Appl. No.: 154,232

[22] Filed: Feb. 10, 1988

[51] Int. Cl.[4] ..... A45D 40/30

[52] U.S. Cl. ..... 132/319; 2/206; 604/303

[58] Field of Search ..... 132/285, 319; 2/206; 604/303

[56] References Cited

U.S. PATENT DOCUMENTS

| | | | |
|---|---|---|---|
| 1,655,440 | 1/1928 | Soble | 2/206 |
| 1,923,340 | 8/1933 | Sheckler | 132/319 |
| 2,096,507 | 10/1937 | Czeszczazki, Jr. | 2/206 X |
| 2,432,767 | 12/1947 | Klein | 2/206 |
| 2,509,519 | 5/1950 | Norris | 2/206 |
| 2,527,726 | 10/1950 | Hendrix | 132/319 |
| 2,625,684 | 1/1953 | Magnvsson | 2/206 |
| 2,628,626 | 0/0000 | Teillaud | 132/216 |
| 2,671,446 | 0/0000 | Mann | 128/163 |
| 2,914,772 | 12/1959 | Lemelson | 2/206 |
| 2,931,369 | 0/0000 | Badovinac | 132/319 |
| 2,964,757 | 12/1960 | Jarvis | 2/206 |
| 3,211,146 | 10/1965 | Rodelli | 604/303 |
| 3,557,805 | 0/0000 | Hamada | 132/216 |
| 4,397,701 | 0/0000 | Johnson et al. | 2/206 |

FOREIGN PATENT DOCUMENTS

| | | | |
|---|---|---|---|
| 932021 | 3/1948 | France | 132/319 |

*Primary Examiner*—Paul J. Hirsch

*Attorney, Agent, or Firm*—Woodard, Emhardt, Naughton Moriarty & McNett

[57] ABSTRACT

A cosmetic template and method of applying cosmetics. A formable sheet of plastic is placed onto a person's face in a heated condition and forced against the face to assume the face shape. A plurality of small circles are marked onto the formed sheet to define the various facial contour features. The sheet is then removed from the face and openings are created in the sheet along the contour lines. The sheet has an elastic band mounted thereon for subsequent remounting to the person's face. A cosmetic pencil is extended through the various openings against the face marking the contour lines created in the template onto the face. The template is removed and cosmetics are applied in accordance with the guidelines on the face.

10 Claims, 1 Drawing Sheet

COSMETIC TEMPLATE

BACKGROUND OF THE INVENTION

This invention is in the field of devices utilized in the application of cosmetics to a person's face. Exceptional skill obtained through years of practice and training is required to correctly apply cosmetics to a person's face. Professional beauticians are able to correctly locate and apply cosmetics on a person's face as well as achieve the desired color and shading to create the desired illusion. Non-professionals may encounter difficulty in achieving the same result, particularly when the cosmetics are to be applied to the face of the same person applying the cosmetics.

I have therefore designed a cosmetic template initially created by the beautician thereby providing a cosmetic guideline to be followed to achieve the desired shading and location. The template may be readily used at home on multiple occasions without further need to consult with the beautician.

Various stencils have been previously provided for the application of cosmetics. For example, U.S. Pat. No. 2,931,369, issued to Badovinac, discloses a stencil for the application of lipstick, whereas U.S. Pat. No. 3,557,805, issued to Hamada, discloses a guide to create a variety of different eyebrow shapes. Another eyebrow guide is disclosed in U.S. Pat. No. 2,628,626, issued to Teillaud. Facial masks are also known such as a theatrical face mask disclosed in U.S. Pat. No. 4,397,701, issued to Johnson, et al., as well as a beauty mask disclosed in U.S. Pat. No. 2,671,446, issued to Mann. The latter mask is worn over an extended period of time for the eradication of wrinkles and for reshaping of facial muscles.

It has not heretofore been known to provide a facial mask initially created by a professional applicator of cosmetics and then utilized at home without further consultation.

SUMMARY OF THE INVENTION

One embodiment of the present invention is a method of applying cosmetics to a person's face comprising the steps of heating a flexible sheet of plastic to a heated condition, placing the sheet in the heated condition against a person's face, forcing the sheet to assume a shape corresponding to various contours of the person's face creating areas to be marked, marking the areas on the sheet, removing the sheet from the person's face, removing various portions from the sheet according to the markings creating a plurality of openings in the sheet, placing the sheet against the person's face immediately prior to application of cosmetics, marking through the openings the person's face with cosmetic guide indicia, and, applying cosmetics according to the cosmetic guide indicia to the person's face.

Another embodiment of the present invention is a tool for use in applying cosmetics to a person's face comprising a flexible sheet of plastic material which when heated is formable to a particular shape and when subsequently cooled will fix the shape therein, the sheet having the shape corresponding to contours of a person's face to which cosmetics are to be applied, the sheet further including a plurality of openings therein associated with the shape through which marks are placed on the person's face.

It is an object of the present invention to provide a template for application of cosmetics.

Another object of the present invention is to provide a template created by a beautician which may then be used by a non-skilled person in applying cosmetics.

In addition, it is an object of the present invention to provide a new and improved method of applying cosmetics to a person's face.

Related objects and advantages of the present invention will be apparent from the following description.

DESCRIPTION OF THE PREFERRED EMBODIMENT

Figure 3:
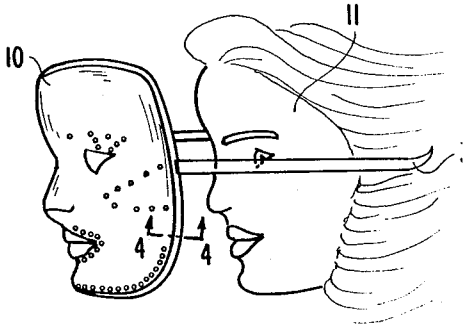
FIG. 3 is a side view of the template of FIG. 2 being placed adjacent a person's face.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawing, there is shown the cosmetic template 10 (FIG. 3) for mounting to a person's face 11 for applying cosmetic guidelines to be used in the application of cosmetics. Template 10 is formed from a flat sheet 12 which is then heated and forced against the face to assume the same shape as the face. Markings are made for shading, illusion and contouring with permanent marking pencils of various colors to further guide the person in color and application of make-up. The template is removed from the face and a plurality of opening are formed in sheet 12 to allow cosmetic guidelines to be marked through the openings onto the face. The template is then removed and the cosmetics are applied in accordance with the cosmetic guidelines marked on the face.

Sheet 12 is produced from a clear plastic material that is non-toxic and safe to the skin. Most importantly, the sheet must have a relatively low melting point of between 120° and 160° F., so that it can be shaped and molded by hand, and then hardened to the final shape. Best results have been obtained by producing the sheet from an extruded plastic material such as polyester having a thickness of between 0.010 to 0.030 inches. One such material which is suitable for use is available in extruded sheets of polyester having a thickness of between 0.100 inches and 0.015 inches.

Figure 4:
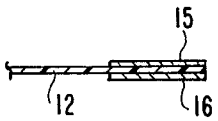
FIG. 4 is a fragmentary enlarged cross-sectional view taken along line 4—4 of FIG. 3 and viewed in the direction of the arrows.

In order to form the template, a pair of breathing holes 13 and 14 are formed in the sheet with the sheet then being mounted into a frame extending circumferentially around the sheet preventing wrinkles and allowing the sheet to be handled with a sufficient amount of control and flexibility. The frame may consist of strips of tape 15 and 16 which extend on the opposite sides and periphery of the sheet. Thus, as shown in FIGS. 3 and 4, strip 15 of tape extends around the circumference of the sheet with the other strip 16 being positioned on the opposite side thereof. The sheet is then dipped in hot water having a temperature of approximately 200° to 240° F. and immediately placed over and in contact with the person's face with care being exercised to align apertures 13 and 14 with the nostrils. The sheet is then forced to assume a shape corresponding to the various contours of face 11 by simply applying fingers against the sheet and forcing the sheet into the various peaks and valleys, and other contours of the face. The mask is then left on the face to cool and permanently set the assumed shape into the sheet.

Sheet 12 is marked with the various contour lines and points once the sheet has hardened to its final set shape. For example, circles may be drawn or marked at the bottom of the sheet to form the chin contour line 17 as well as the lip line 18. Further, cheek contour lines 19 and eyebrow lines 20 are formed by drawing or marking similar circles onto the sheet while it is adjacent face 11. The nose contour lines 21 are formed by marking circles onto the sheet on the opposite sides of the nose and blush areas 22 and 23 are formed by marking circles forming the cheek contour lines 19 on the sheet. A pair of openings 24 and 25 are marked on the sheet following the outline of the person's eyes. Shadow shade areas 26 and 27 adjacent the eyes are indicated by marking a plurality of circles 28 extending rearwardly from the eyes.

Figure 2:
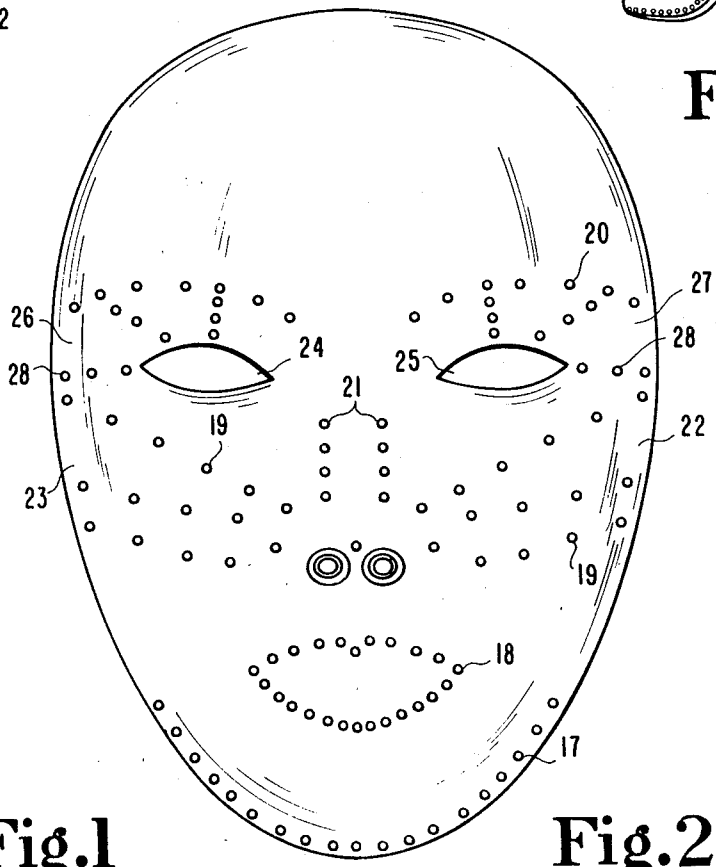
FIG. 2 is the same view as FIG. 1 only showing the sheet formed to its final shape.
Figure 1:
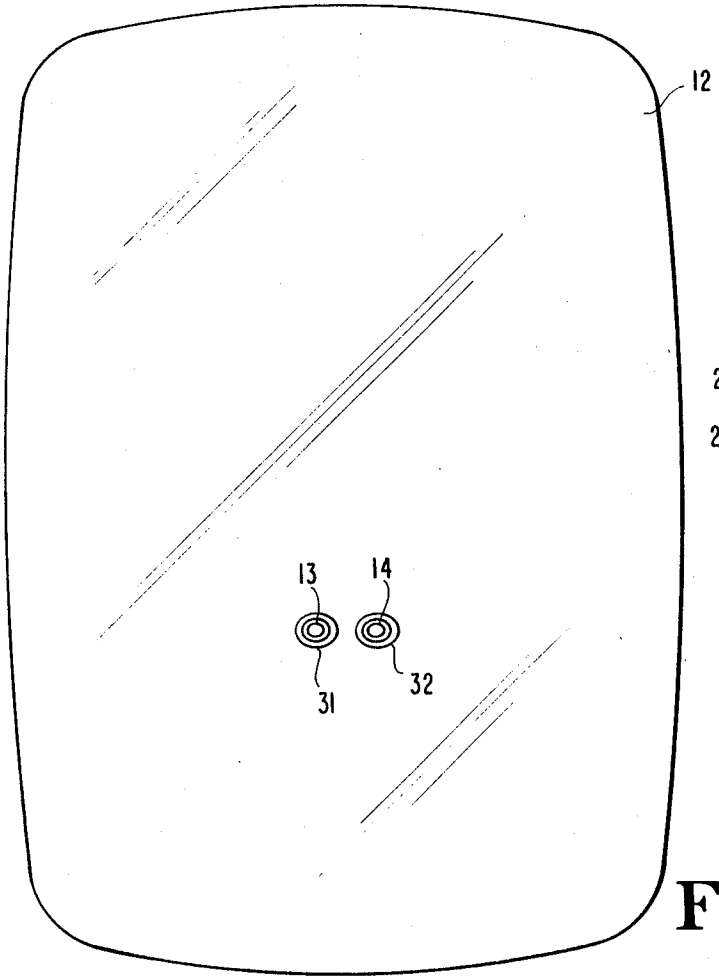
FIG. 1 is a plan view of an unformed sheet to be used with the instant invention.

The marked sheet is removed from the person's face. The sheet is next cut to remove portions therefrom creating eyeholes 24 and 25. The various small circles shown in FIG. 2 and defining the chin contour line 17, lip line 18, cheek contour lines 19, nose contour lines 21 and eyebrow lines 20, along with any additional small circles marked onto the sheet are individually heated to melt the plastic material therefrom. For example, a heated pointed object such as a rod is extended through each of the circles defining the chin contour line thereby melting the plastic material within each small circle. The circles marked onto the sheet have an approximate diameter of 1/16th to ⅛th inch.

An elastic band 30 has a pair of opposite ends fixedly attached to each edge of the sheet approximately located adjacent each eye. The mask may then be removably mounted to a person's face. Further, a pair of self-adhesive hole reinforcement labels 31 and 32 may be mounted to the sheet surrounding holes 13 and 14 to add further rigidity to the material surrounding the breathing holes. Such labels are commercially available such as those used to reinforce paper surrounding a hole in looseleaf paper and are available from any office supply store.

Once the template is completely formed, marked and the various portions within the marked circles removed from the sheet, the template is ready to be used for the application of cosmetics to a person's face. Thus, the template is repositioned adjacent face 11 and a cosmetic pencil or other means is extended through each hole marking the face and defining the various contour lines or cosmetic guidelines on the face. The template is then removed from the face with the various contour guide lines on the face allowing the person to then apply the cosmetics according to the various lines marked thereon.

The cosmetic template and method disclosed herein has many advantages as compared to the prior means for application of cosmetics. The chief advantage is that the template is originally formed by a professionally trained beautician who will not only shape the template to the person's face, but also mark the various contour lines thereon and remove the portions from the template defining the contour lines. The template may then be given to the person who may repeatedly use the template at home to mark on her face the various cosmetic guidelines simply by inserting a cosmetic pencil through the various openings thereby marking the face in accordance with the beautician's prior study. The user may then remove the template and apply the cosmetics in accordance with the cosmetic guidelines already marked on the face. That is, cosmetics may be applied along each line or between a set of lines depending upon the beautician's instructions.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method to be used for allowing cosmetics to be applied to a person's face comprising the steps of:
   heating a flexible sheet of plastic to a heated condition;
   placing said sheet in said heated condition against a person's face;
   forcing said sheet to assume a shape corresponding to various contours of the person's face creating areas to be marked;
   marking said areas on said sheet; and,
   removing various portions from said sheet according to said marking creating a pluraity of openings in said sheet for tracing cosmetic guides onto the person's face.

2. The method of claim 1 and further comprising:
   forming breathing holes in said sheet; and,
   leaving said sheet on the person's face to cool and assume a fixed contour.

3. The method of claim 2 and further comprising:
   marking cosmetic guide indicia through said openings onto the person's face.

4. The method of claim 3 and further comprising:
   mounting eyelets around said breathing holes;
   cooling said sheet after said shape is created to fix said shape in said sheet; and,
   melting said sheet at said markings to remove said various portions from said sheet.

5. The method of claim 4 and further comprising:
   applying cosmetics to the person's face according to said cosmetic guide indicia.

6. The method of claim 5 wherein:
   said placing of said sheet in a heated condition includes inserting said sheet into water having a temperature in excess of 200° F.

7. A method of applying cosmetics to a person's face comprising the steps of:
   heating a flexible sheet of plastic to a heated condition;
   placing said sheet in said heated condition against a person's face;

forcing said sheet to assume a shape corresponding to various contours of the person's face creating areas to be marked;

marking said areas on said sheet;

removing said sheet from the person's face;

removing various portions from said sheet according to said markings creating a plurality of openings in said sheet;

placing said sheet against the person's face immediately prior to application of cosmetics;

marking through said openings the person's face with cosmetic guide indicia; and, applying cosmetics according to said cosmetic guide indicia to the person's face.

8. The method of claim 7 and further comprising:

forming breathing holes in said sheet; and, leaving said sheet on the person's face to cool and assume a fixed contour.

9. The method of claim 8 and further comprising:

placing eyelets on said breathing holes;

cooling said sheet after said shape is created to fix said shape in sid sheet;

melting said sheet at some of said markings to remove portions from said sheet; and, cutting said sheet at some of said markings corresponding to location of the eyes to remove portions from said sheet.

10. A cosmetic template for use in applying cosmetics to a person's face comprising:

flexible plastic means including a thin plastic sheet and operable when heated to a heated condition and forceably placed against a person's face in said heated condition to be formable to a particular shape corresponding to contours of a person's face to which cosmetics are to be applied and when subsequently cooled to fix said shape therein; and, marking and removal means operable to contact and mark areas on said thin plastic sheet and to further remove said areas forming openings in said thin plastic sheet for tracing cosmetic guides onto the person's face.

* * * * *

UNITED STATES PATENT AND TRADEMARK OFFICE

CERTIFICATE OF CORRECTION

PATENT NO. : 4,886,079

DATED : December 12, 1989

INVENTOR(S) : Lillian A. Mooney

It is certified that error appears in the above-identified patent and that said Letters Patent is hereby corrected as shown below:

In column 4, line 40, please delete "pluraity" and substitute therefor --plurality--.

In column 6, line 2, please delete "sid" and substitute therefor --said--.

Signed and Sealed this

Thirtieth Day of October, 1990

*Attest:*

HARRY F. MANBECK, JR.

*Attesting Officer*

*Commissioner of Patents and Trademarks*